US005379018A

United States Patent [19]

De Wames et al.

[11] Patent Number: 5,379,018

[45] Date of Patent: Jan. 3, 1995

[54] HIGH TEMPERATURE SUPERCONDUCTOR MAGNETIC-SWITCH

[75] Inventors: Roger E. De Wames; Ira B. Goldberg; Peter E. D. Morgan; Joseph J. Ratto; David B. Marshall; William F. Hall, all of Thousand Oaks, Calif.

[73] Assignee: Rockwell International Corporation, Seal Beach, Calif.

[21] Appl. No.: 727,763

[22] Filed: Jul. 10, 1991

Related U.S. Application Data

[63] Continuation-in-part of Ser. No. 303,708, Jan. 27, 1989.

[51] Int. Cl.[6] ..... H01F 7/22

[52] U.S. Cl. ..... 505/211; 324/248; 335/216

[58] Field of Search ..... 335/216; 174/125.1; 324/248; 505/1, 705, 727, 803, 832, 845, 924

[56] References Cited

U.S. PATENT DOCUMENTS

| | | | |
|---|---|---|---|
| 3,691,491 | 9/1972 | Massar | 335/216 |
| 4,489,274 | 12/1984 | Berlincourt | 324/248 |
| 4,797,386 | 1/1989 | Gyorgy et al. | 505/1 |
| 5,075,280 | 12/1991 | Pisharody et al. | 505/1 |

FOREIGN PATENT DOCUMENTS 247963 10/1988 Japan .

*Primary Examiner*—Leo P. Picard
*Assistant Examiner*—Raymond Barrera
*Attorney, Agent, or Firm*—John J. Deinken

[57] ABSTRACT

A magnetic switch for recording the change in position of a magnetic field includes a first object on which is positioned a source of magnetic force for creating a magnetic field and a second object on which is positioned at least one type II superconducting medium. The type II superconducting medium exhibits a permanent magnetic component after exposure to a magnetic field, such that relative motion between the first object and the second object causes the magnetic field to induce a residual magnetization in the superconducting medium. A device for sensing the direction of a magnetic field includes a first type II superconducting medium adapted to exhibit a permanent magnetic component after exposure to a magnetic field having a first direction, a second type II superconducting medium adapted to exhibit a permanent magnetic component after exposure to a magnetic field having a second direction orthogonal to the first direction, and a third type II superconducting medium adapted to exhibit a permanent magnetic component after exposure to a magnetic field having a third direction orthogonal to the first and second directions.

6 Claims, 12 Drawing Sheets

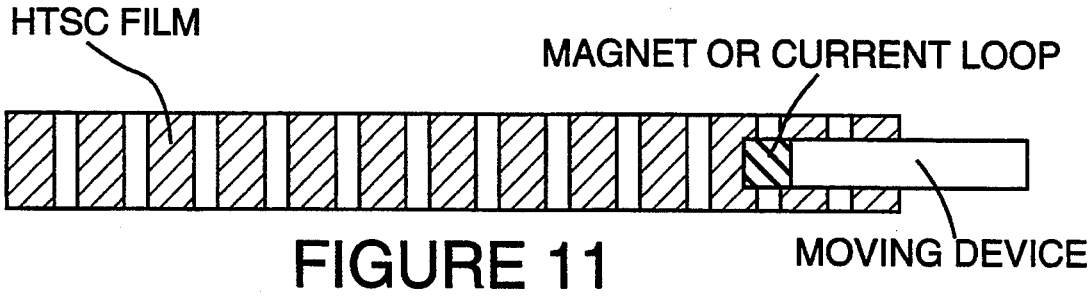
FIGURE 11
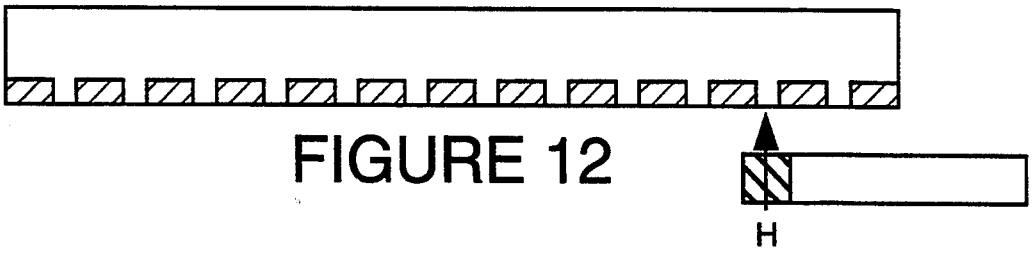
FIGURE 12
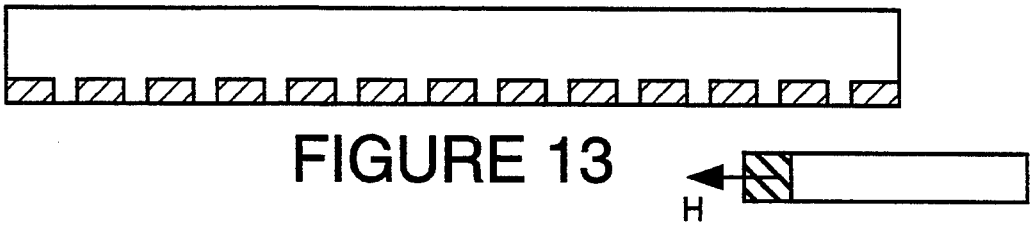
FIGURE 13
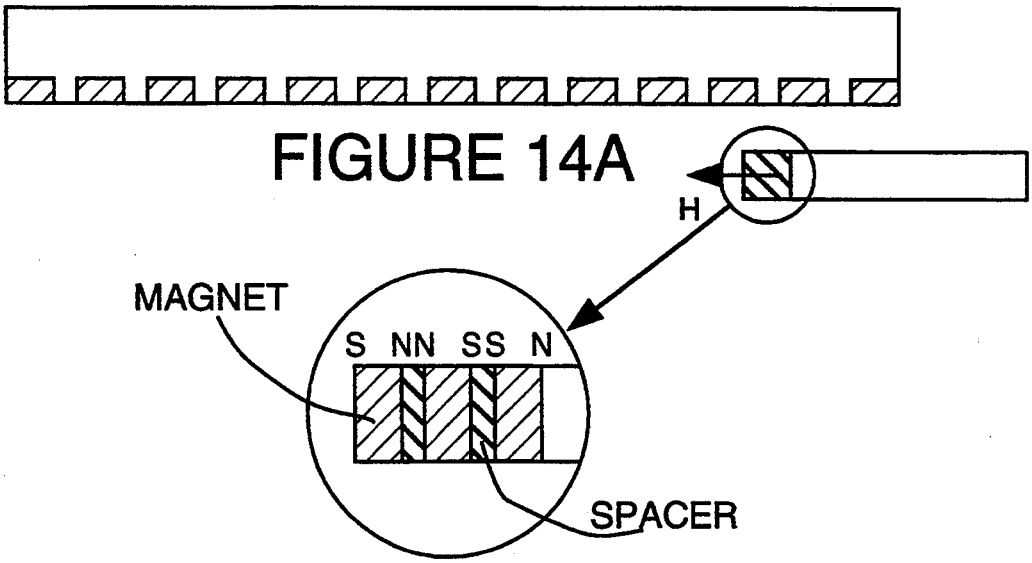
FIGURE 14A
FIGURE 14B

HIGH TEMPERATURE SUPERCONDUCTOR MAGNETIC-SWITCH

CROSS-REFERENCE TO RELATED APPLICATIONS

This application is a continuation-in-part of application Ser. No. 303,708, filed Jan. 27, 1989.

BACKGROUND OF THE INVENTION

This invention is concerned with the magnetic properties of superconducting materials. The field of superconductivity was revolutionized in April 1986 with the discovery by Bednorz and Muller that certain types of metallic oxides become superconducting at temperature considerably higher than the highest critical temperature ($T_c$) previously known for any superconducting material. Superconductors exhibit zero resistance, diamagnetism (the Meissner effect), Josephson tunneling, and a forbidden energy gap. These effects are observed in both soft (type I) and hard (type II) superconducting materials. The above phenomena have been extensively studied to understand the origins and physical mechanisms of these attributes and to find uses for these materials to meet the needs of society.

SUMMARY OF THE INVENTION

A magnetic switch for recording the change in position of a magnetic field includes a first object on which is positioned a source of magnetic force for creating a magnetic field and a second object on which is positioned at least one type II superconducting medium. The type II superconducting medium exhibits a permanent magnetic component after exposure to a magnetic field, such that relative motion between the first object and the second object causes the magnetic field to induce a residual magnetization in the superconducting medium.

The type II superconducting medium may further be a planar type II superconducting medium, with the source of magnetic force a source of magnetic force for creating a magnetic field in a direction orthogonal to the surface of the superconducting medium or the source may be a source of magnetic force for creating a magnetic field in a direction parallel to the surface of the superconducting medium.

A device for sensing the direction of a magnetic field includes a first type II superconducting medium adapted to exhibit a permanent magnetic component after exposure to a magnetic field having a first direction, a second type II superconducting medium adapted to exhibit a permanent magnetic component after exposure to a magnetic field having a second direction orthogonal to the first direction, and a third type II superconducting medium adapted to exhibit a permanent magnetic component after exposure to a magnetic field having a third direction orthogonal to the first and second directions. In a more particular embodiment, the first, second, and third media each is a planar type II superconducting medium such that the first medium is perpendicular to the second medium and the third medium is perpendicular to the first and second media.

DESCRIPTION OF THE DRAWINGS

In FIG. 6, the magnets are placed on the superconductor to induce the remanent fields and then removed. In FIG. 7, the plot of the remaining magnetic field illustrates the reversal of the magnetized domains which occurred.

FIGS. 11–14 are cross sectional schematic illustrations of a magnetic switch constructed according to the invention to determine the path of a moving object.

DESCRIPTION OF THE INVENTION

Figure 1:
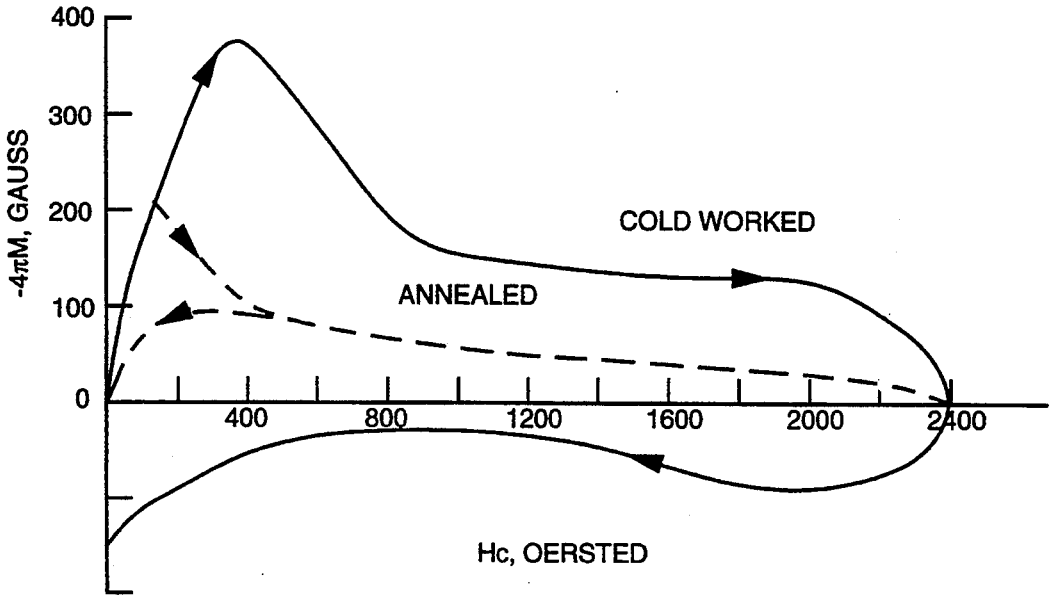
FIG. 1 is a plot of magnetization as a function of magnetic field for a low temperature superconductor.
Figure 2:
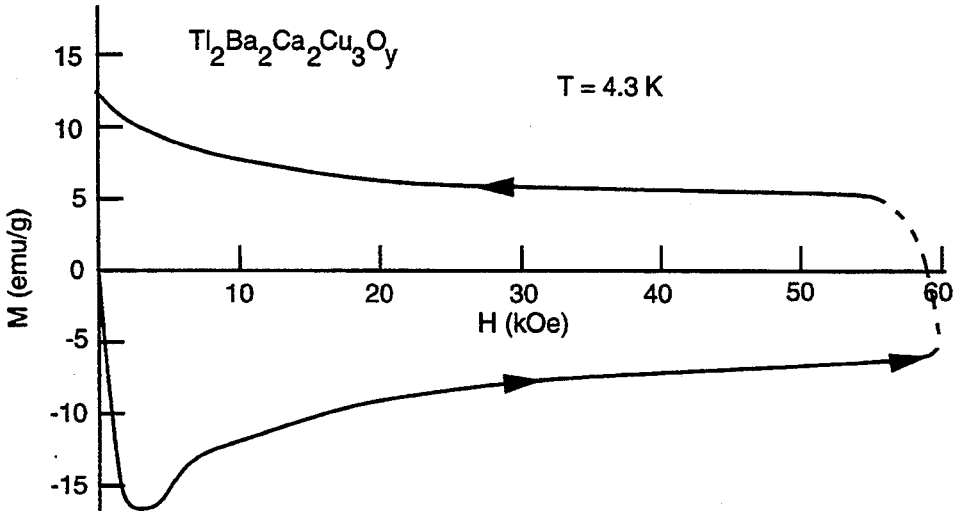
FIG. 2 is a plot of magnetization as a function of magnetic field similar to FIG. 1 but for a high temperature superconducting material.

In type II superconductors large hysteresis in magnetization measurements is usually observed both in low temperature superconductors (LTS) and the recently discovered high temperature superconductors (HTS). FIG. 1 is a plot of magnetization as a function of magnetic field for an LTS (from Livingston, Physical Review, Volume 129. Page 1943 (1963)), while FIG. 2 illustrates the magnetization curve for an HTS (Iwasaki, et al., Japanese Journal of Applied Physics, Volume 27, Page L1631 (1988)). Similar data for a bismuth compound superconductor was reported by M. Baran, et al., Journal of Physics C. Solid State Physics, Volume 21, Page 6153 (1988).

Figure 3:
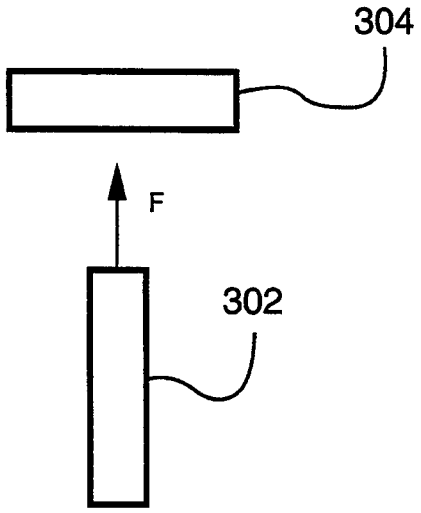
FIG. 3 illustrates the suspension of a small magnet from a thallium superconductor which was previously magnetized with a larger magnet having a strength of 3 KGauss.

Note that the vertical axis in the LTS case is $-4\pi M$. Whereas for HTS it is $4\pi M$. It is an outstanding feature of this invention to make use of the fact that in Type II superconductors the hysteresis loop is the diamagnetic equivalent of the hysteresis observed in weakly magnetized ferromagnets. (see Beam, Review of Modern Physics, Volume 36, Page 31 (1964). This can be seen by completing the curves in FIGS. 1 and 2 for negative values of the applied field. At a zero field value a remanent moment is induced and this moment is oriented in the direction of the applied field. Hence the sample exhibits both diamagnetism and ferromagnetism. This attribute explains the observations of suspension of either HTS or LTS superconductors from magnets (Harter, et al, Applied Physics Letters, Volume 53, Page 1120 (1988); Adler, et al., Applied Physics Letters, Volume 53, Page 2346 (1988)) or magnets from superconductors (Marshall, et al., U.S. Pat. No. 4,879,537), the condition being that the spatial derivative of the magnetic force is positive. The net magnetic force has both a negative and positive component, the repulsive component having its origin in the diamagnetic properties, while the attractive component arises from the magnetic properties. In FIG. 3 is illustrated the suspension of a small magnet 302 from a thallium superconductor 304 which was previously magnetized with a larger magnet having a strength of 3 KGauss. In this situation, both in levitation and suspension experiments, the small magnet orients so that its moment is parallel to the remanent moment induced by the large magnet. The levitation condition is satisfied by the diamagnetic force.

Figure 4:
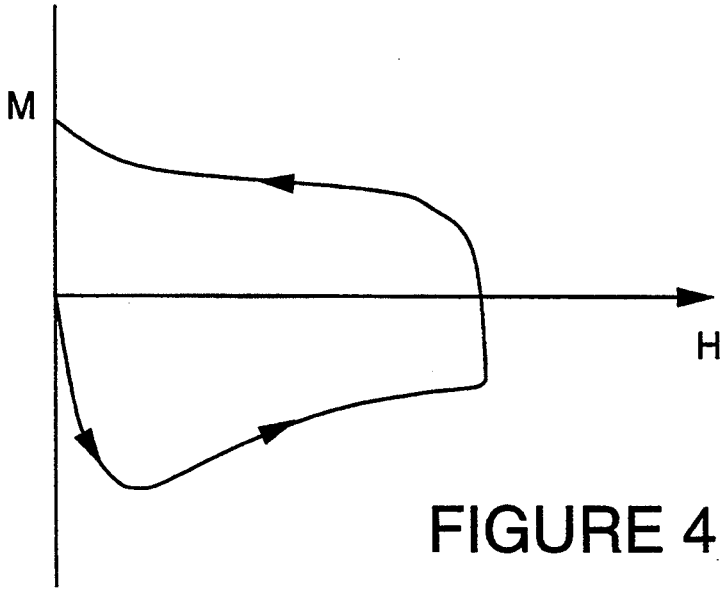
FIG. 4 is a plot of magnetization as a function of magnetic field.
Figure 5:
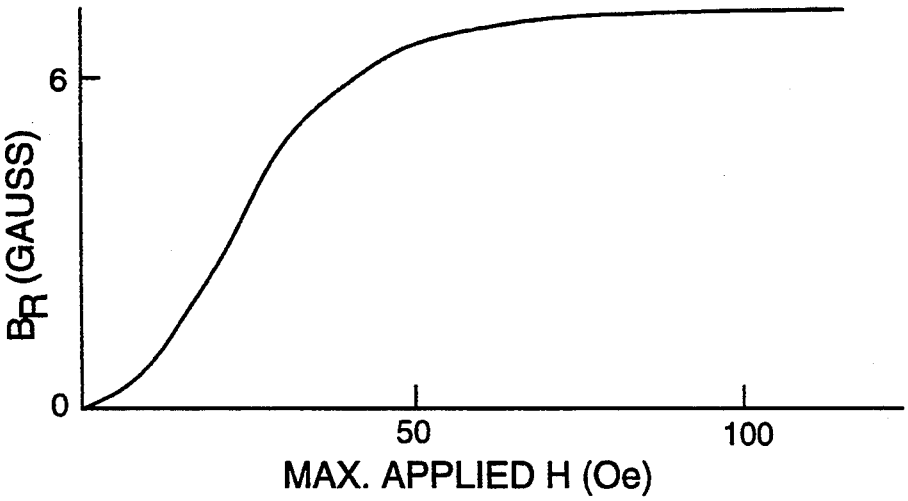
FIG. 5 illustrates the remanent field plotted as a function of the applied field.

FIGS. 4–7 illustrate the data which supports the potential use of this attribute of type II superconductors which exhibit a permanent magnetic component following the removal of the applied field. FIG. 4 is a plot of magnetization as a function of magnetic field depicting measurements made by Iwasaki, et al. FIG. 5 illustrates the remanent field plotted as a function of the applied field. Note that saturation is observed at relatively small field values. The magnitude of the saturated field will depend on the material system and the microstructure which provides the centers for flux trapping. Similar to the observation that high current densities are related to pinning forces, high remanent fields also depend on the mechanisms of pinning. Based on a physical model for the structure of these types of materials proposed by Mendelssohn (Proceedings of the Royal Society (London), Volume A152, Page 34 (1935)), Bean developed expressions for the magnetization of such specimens. (Bean, Physical Review Letters, Volume 8, Page 250 (1962); Volume 9, Page 93 (1962)). In this model the calculation of the critical current density $J_c$ of the filaments is the limiting parameter. This parameter is a sensitive function of the material properties and the ability to support high remanent fields is directly related to the properties required to support high critical currents. The Bean calculation captures the basic physics but the situation is likely to be more complex. Since the above measurements were performed at liquid nitrogen temperatures, it is expected that the saturation value of the remanent field will increase with decreasing temperature since the trapping mechanism is believed to be a thermally activated process.

This signature can be modified or erased by increasing the temperature, passing a high current, or alternating the field. Hence it is possible to utilize the phenomenon to achieve rotor motion of a small magnet suspended or levitated from a superconductor.

Figure 6:
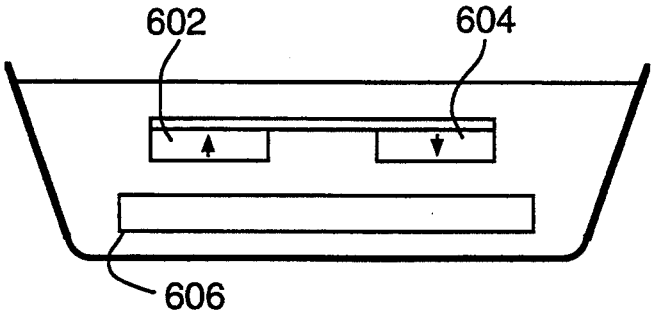
FIGS. 6 and 7 are schematic diagrams illustrate the spatial magnetization of a superconductor.
Figure 7A:
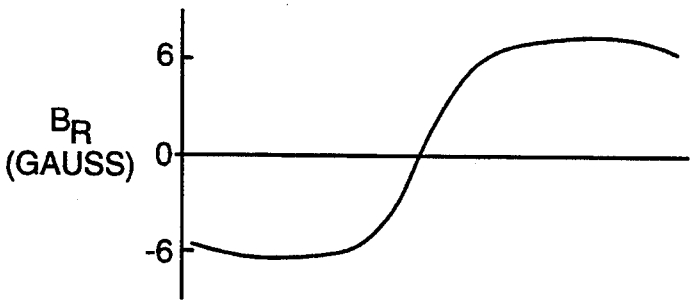
Figure 7B:
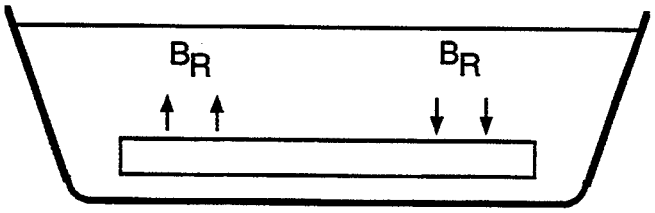

FIGS. 6 and 7 illustrate the use of this invention to spatially magnetize a superconductor. In FIG. 6, the magnets 602 and 604 were placed on the superconductor 606 to induce the remanent fields and then removed. In FIG. 7, the data illustrate the reversal of the magnetized domains which occurred. A significant question is the limit of the spatial frequency of this change in magnetization which can be supported by the superconductors. In principle from fundamental considerations the upper limit will be controlled by the coherence length which is of the order of tens of Angstroms in these materials. In real situations this spatial frequency is likely to be limited by the nature and type of pinning force which inhibits the motion of flux.

One application for this invention involves magnetic switches. Few magnetic materials offer both high magnetic remanence (memory) and low coercivity. None offer the feature of complete erasure, because the magnetization of each must remain constant, but the direction will change.

Figure 8:
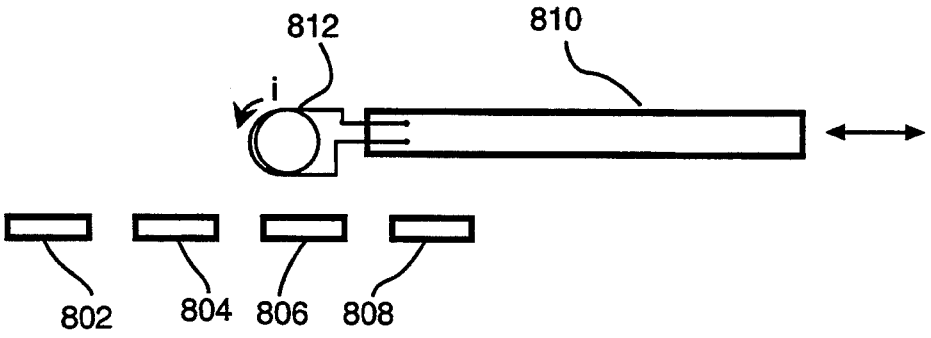
FIG. 8 illustrates the use of the invention as a magnetic switches for sensing the position of a moving part which has an attached coil of wire in which an electrical current is flowing.

Magnetic switches are used for sensing the rotation of wheels, gears, and shafts, and for sensing the direction of motion. FIG. 8, for example, shows this invention applied to use type II superconductors 802–808 for sensing the position of a moving part 810 which has an attached coil of wire 812 in which an electrical current is flowing. Such superconductors can also be used for imaging current flow. Experimental results show that the superconductor is easily saturated, and retains memory of the direction of the magnetic field. Thus, the remanence is high, but the coercivity is low. The memory can be completely erased by elevating the temperature above the critical point or passing a large DC current through the superconductor. As a result, such magnetic material can be used for imaging magnetic changes or current flow with a resolution of 0.005 micrometers. Applications of such materials could be envisioned for imaging the current flow in semiconductor devices, detecting motion of fine particles, counting shaft rotation, and any other application of switching devices.

Figure 9:
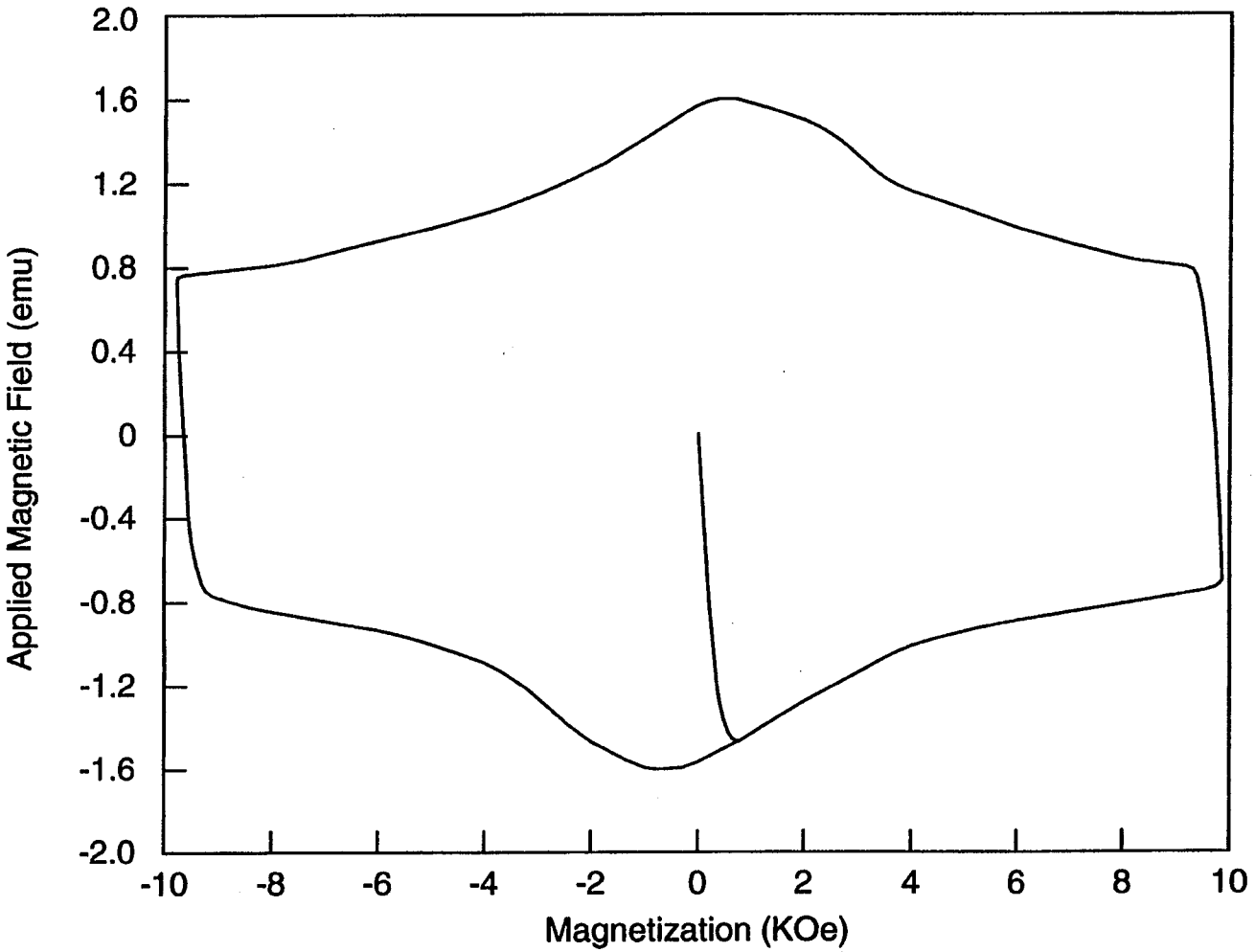
FIG. 9 is a plot of magnetization versus applied magnetic field similar to the plots of FIGS. 1 and 2, for a high temperature superconductor at a temperature of 4K.
Figure 10:
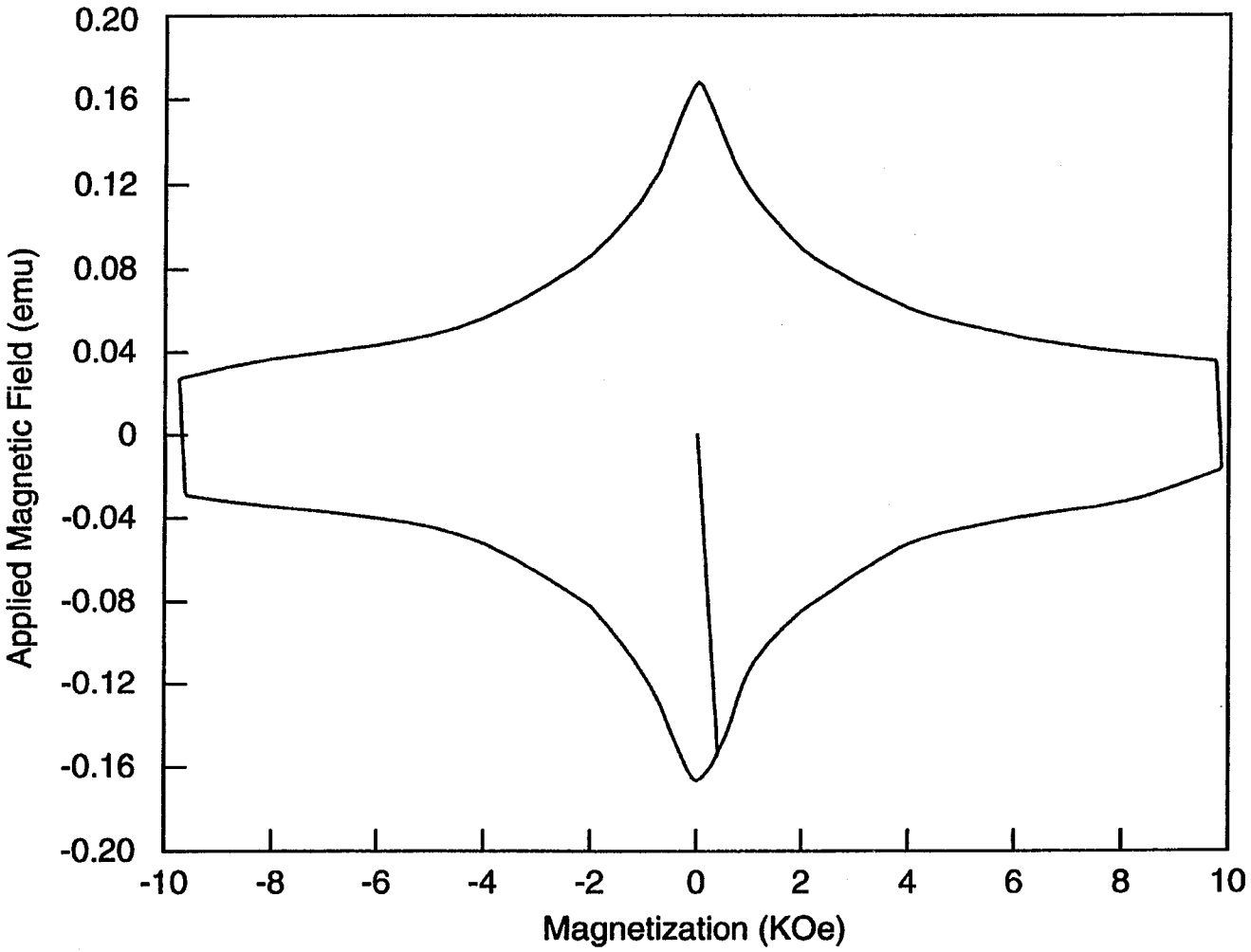
FIG. 10 is a plot similar to FIG. 9, but for the same superconducting material at a higher temperature of 70K.

FIG. 2 shows a typical M-H loop for a superconductor. Although the magnitude will vary among materials, the shape of the curve is typical, regardless of which HTSC is being measured. A complete loop, consisting of five quadrants, will appear as shown in FIG. 9, which is a plot of magnetization versus applied magnetic field similar to the plots of FIGS. 1 and 2. In FIG. 9, the HTSC initially has no residual magnetization. The magnetic field is first scanned in the positive direction to a given magnetic field value. That is, $M=0$ as shown. As the field increases, the magnetization becomes more negative. The magnitude is proportional to the applied field. In this low field region, M will follow H in either direction. At a value of H somewhat smaller than the minimum shown in FIG. 9, the increase of M with H will no longer be linear. This point may be denoted $H_{C1}$. As H is further increased, the magnitude of M reaches a maximum and then decreases slowly with the change in the field value. The second quadrant is recorded as the field is slowly returned to zero. When the field is initially reduced from its maximum value, the direction of magnetization will be reversed. M will continue to increase as the field is brought back to zero. The third quadrant is recorded by scanning the field back to a large value in the negative direction. This data was taken with a barium HTSC sample at 4K. The same sample was also measured at 70K and these results are plotted in FIG. 10. As can be gleaned from a comparison of FIGS. 9 and 10, the shape of the curve differs at the higher temperature and the end of the linear region of M vs. H occurs at smaller applied fields.

If the magnetic field is scanned beyond the minimum shown in FIG. 2 and the field is then returned to zero, the resultant magnetization will be that shown as the maximum. For convenience, the field H at the minimum value of M may be denoted as $H_{min}$. A key characteristic of the M-H behavior is that the field (H) that corresponds to the minimum will decrease as the temperature increases. This field value will also be a function of the nature of the material and to some extent it will depend on the film thickness. Thus, the "coercivity" can be controlled by temperature, material, and film thickness.

One other characteristic of HTSC materials is important to this invention. The magnetic susceptibility, $\chi$, at low magnetic fields is $-1$. Because of the nature of magnetic fields each material exhibits a geometric demagnetization factor, D. In thin films, the demagnetization factor in the plane of the material, $D_{\parallel}$, is 0, while the demagnetization factor normal to the plane, $D_{\perp}$, is 1. When a magnetic field is applied to the material, the apparent susceptibility, $\chi_{app}$, (the measured response to a magnetic field) is given by $$\chi_{app} = \frac{\chi}{1 + D\chi}$$

Thus, when the field is applied parallel to the HTSC film, $\chi_{\parallel} = \chi$, but when the field is applied perpendicular to the surface, $\chi_{\perp} \rightarrow \infty$. As a consequence, the sensitivity to a magnetic field is extremely high when the field is applied normal to the thin film.

An HTSC can be used as a magnetic switch in a number of ways. One embodiment of this invention is illustrated in cross sectional schematic form in FIGS. 11–14. In this example, HTSC films are mounted parallel to the path of a moving object (e.g. on a line as shown or around a wheel). The moving object contains a magnet or a current loop to generate a magnetic field. There are two methods of using such a device.

In the first case, the moving device is provided with a magnetic field perpendicular to the plane of the HTSC as shown in FIG. 12. If the field generated by the coil or magnet on the moving device is greater than $H_{min}$ a residual magnetization will be left in the HTSC film. The fact that the moving device passed by this path can be determined at a later time, either by changes in critical current or by another means of measuring the field in the HTSC. If the field is smaller than $H_{C1}$, then the position can be sensed only when the object is near the ttTSC element.

In the second case, the magnetic field on the moving object is oriented such that the direction of the magnetic field in the magnet is parallel to the plane of the HTSC, as shown in FIG. 13. The HTSC is then magnetized by an external field that exceeds $H_{min}$ at the HTSC. In this configuration, the thin film HTSC is not sensitive to the component of magnetization parallel to its plane, but very sensitive to the component of field normal to its plane as described above. In such an application, the direction of magnetization within the HTSC is sensitive to the direction of motion of the device.

A refinement of the FIG. 13 embodiment is that shown in FIG. 14. In this case, there are three magnets arranged on the moving device. This magnet geometry creates stronger fields normal to the HTSC surface than would a single magnet.

Figure 15:
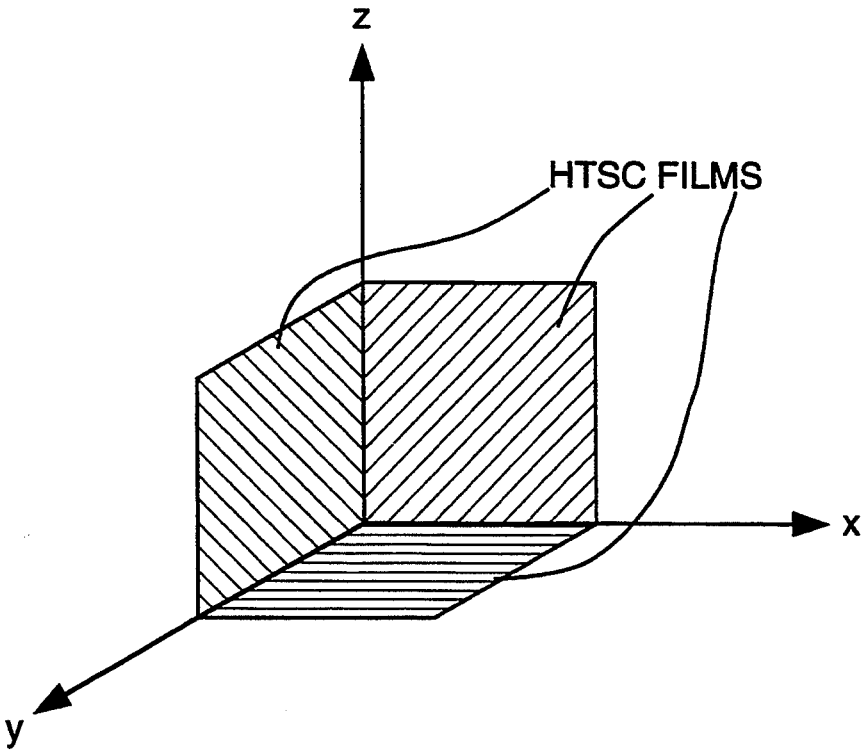
FIG. 15 depicts an embodiment of the invention which is used to sense the direction of a magnetic field.

A second application for a magnetic switching device utilizes the HTSC to sense the magnetic field direction. Either 1, 2, or 3 HTSC films can be arranged to sense the direction of the magnetic field. The embodiment illustrated in FIG. 15 depicts three HTSC films, one each being positioned in the xy, xz, and yz planes, so that the surface of each film is orthogonal to the surfaces of the other two films. HTSC film 1 senses fields in the y direction, 2 senses fields in the z direction, and 3 senses fields in the x direction.

In these embodiments, the switching occurs through the change of direction of the magnetic field in the HTSC, not switching between a superconductive and normal state. The latter mode of operation cannot be achieved with HTSC materials at reasonable field values.

The preferred embodiments of this invention have been illustrated and described above. Modifications and additional embodiments, however, will undoubtedly be apparent to those skilled in the art. Furthermore, equivalent elements may be substituted for those illustrated and described herein, parts or connections might be reversed or otherwise interchanged, and certain features of the invention may be utilized independently of other features. Consequently, the exemplary embodiments should be considered illustrative, rather than inclusive, while the appended claims are more indicative of the full scope of the invention.

The teaching of the following documents, which are referred to herein, is incorporated by reference:

Adler, et al., Applied Physics Letters, Volume 53, Page 2346 (1988);
Baran, et al., Journal of Physics C. Solid State Physics, Volume 21, Page 6153 (1988);
Beam, Review of Modern Physics, Volume 36, Page 31 (1964);
Bean, Physical Review Letters, Volume 8, Page 250 (1962), Volume 9, Page 93 (1962);
Harter, et al, Applied Physics Letters, Volume 53, Page 1120 (1988);
Iwasaki, et al., Japanese Journal of Applied Physics, Volume 27, Page L1631 (1988);
Livingston, Physical Review, Volume 129, Page 1943 (1963);
Marshall, et al., U.S. Patent Application No. 223,591, filed July 25, 1988;
Mendelssohn (Proceedings of the Royal Society (London) Volume A152, P 34 (1935).

We claim:

1. A magnetic switch for recording the change in position of a magnetic field, comprising:

a first object on which is positioned a source of magnetic force for creating a magnetic field;

a second object on which is positioned at least one type II superconducting medium which exhibits a permanent magnetic component after exposure to a magnetic field, such that relative motion between the first object and the second object causes the magnetic field to induce a residual magnetization in the superconducting medium; and means for measuring the residual magnetization induced in the superconducting medium.

2. The magnetic switch of claim 1, wherein the type II superconducting medium further comprises a planar type II superconducting medium.

3. The magnetic switch of claim 2, wherein the source of magnetic force further comprises a source of magnetic force for creating a magnetic field in a direction orthogonal to the surface of the superconducting medium.

4. The magnetic switch of claim 2, wherein the source of magnetic force further comprises a source of magnetic force for creating a magnetic field in a direction parallel to the surface of the superconducting medium.

5. A device for sensing the direction of a magnetic field, comprising:

a first type II superconducting medium adapted to exhibit a permanent magnetic component after exposure to a magnetic field having a first direction;

a second type II superconducting medium adapted to exhibit a permanent magnetic component after exposure to a magnetic field having a second direction orthogonal to the first direction;

a third type II superconducting medium adapted to exhibit a permanent magnetic component after exposure to a magnetic field having a third direction orthogonal to the first and second directions; and means for measuring the direction of any permanent magnetic component induced in the first, second, or third superconducting medium.

6. The device of claim 5, wherein the first, second, and third media each further comprises a planar type II superconducting medium such that the first medium is perpendicular to the second medium and the third medium is perpendicular to the first and second media.

* * * * *